US010400567B2

(12) United States Patent
Liu et al.

(10) Patent No.: US 10,400,567 B2
(45) Date of Patent: Sep. 3, 2019

(54) PIPELINE DESCALING AND ROCK STRATUM FRACTURING DEVICE BASED ON ELECTRO-HYDRAULIC PULSE SHOCK WAVES

(71) Applicant: HUAZHONG UNIVERSITY OF SCIENCE AND TECHNOLOGY, Wuhan, Hubei (CN)

(72) Inventors: Yi Liu, Hubei (CN); Fuchang Lin, Hubei (CN); Yuan Pan, Hubei (CN); Qin Zhang, Hubei (CN); Hua Li, Hubei (CN); Zhiyuan Li, Hubei (CN); Siwei Liu, Hubei (CN)

(73) Assignee: HUAZHONG UNIVERSITY OF SCIENCE AND TECHNOLOGY, Wuhan, Hubei (CN)

( * ) Notice: Subject to any disclaimer, the term of this patent is extended or adjusted under 35 U.S.C. 154(b) by 0 days.

(21) Appl. No.: 15/749,583

(22) PCT Filed: Sep. 29, 2016

(86) PCT No.: PCT/CN2016/100725

§ 371 (c)(1),
(2) Date: Feb. 1, 2018

(87) PCT Pub. No.: WO2018/058401

PCT Pub. Date: Apr. 5, 2018

(65) Prior Publication Data

US 2019/0017362 A1 Jan. 17, 2019

(30) Foreign Application Priority Data

Sep. 27, 2016 (CN) ..... 2016 1 0853849

(51) Int. Cl.
*E21B 43/26* (2006.01)
*E21B 43/00* (2006.01)
(Continued)

(52) U.S. Cl.
CPC ..... *E21B 43/26* (2013.01); *B08B 9/02* (2013.01); *E21B 28/00* (2013.01); *E21B 37/00* (2013.01); *E21B 43/003* (2013.01)

(58) Field of Classification Search
CPC ..... E21B 43/003
(Continued)

(56) References Cited

U.S. PATENT DOCUMENTS

2011/0259593 A1 10/2011 Kostrov et al.

FOREIGN PATENT DOCUMENTS

CN 102094604 6/2011
CN 104481574 4/2015
(Continued)

*Primary Examiner* — Anna M Momper
*Assistant Examiner* — Patrick F Lambe
(74) *Attorney, Agent, or Firm* — Hamre, Schuman, Mueller & Larson, P.C.

(57) ABSTRACT

The invention discloses a pipeline descaling and rock stratum fracturing device based on electro-hydraulic pulse shock waves, comprising a ground low-voltage control device, a transmission cable and an electro-hydraulic pulse shock wave transmitter. The invention generates available high-strength shock waves with repetition frequency to bombard a specific position of the pipeline or rock stratum so as to achieve the effect of pipeline descaling and rock stratum fracturing; the breakdown field strength of the liquid gap can be effectively reduced to improve the conversion efficiency of the electrical energy to the mechanical energy of the electro-hydraulic pulse shock wave so as to obtain a high-strength electro-hydraulic pulse shock wave; the transmitting cavity adopts a parabolic focusing cavity, and through refraction and reflection of the rotating parabolic cavity, the shock wave is focused in a preset direction and radiates outwards to act on the pipeline dirt or rock stratum while ensuring that the shock wave has no longitudinal component and does not will not damage the liquid within
(Continued)

the pipeline and the pipeline sheath, so that the effect of pipeline descaling or rock stratum fracturing is improved after focusing. The invention has the advantages of effectively removing the pipeline dirt, fracturing the rock stratum and improving the permeability as well as high reliability, environmental friendliness and low cost.

13 Claims, 6 Drawing Sheets

(51) Int. Cl.
*E21B 28/00* (2006.01)
*B08B 9/02* (2006.01)
*E21B 37/00* (2006.01)

(58) Field of Classification Search
USPC ..... 166/177.5
See application file for complete search history.

(56) References Cited

FOREIGN PATENT DOCUMENTS

| | | | |
|---|---|---|---|
| CN | 105201475 | | 12/2015 |
| CN | 105932757 | | 9/2016 |
| CN | 105952426 | | 9/2016 |
| CN | 105952426 A | * | 9/2016 |

* cited by examiner (a) (b)

(a) (b) (c)

(a)

(b)

(a)

(b)

PIPELINE DESCALING AND ROCK STRATUM FRACTURING DEVICE BASED ON ELECTRO-HYDRAULIC PULSE SHOCK WAVES

BACKGROUND OF THE INVENTION

Field of the Invention

The invention relates to the fields of high voltage technology, pulse power technology, oil and gas exploitation and rock fracture, and more particularly, to a pipeline descaling and rock stratum fracturing device based on electro-hydraulic pulse shock waves.

Description of the Related Art

Rapid arc discharge induced by the high voltage takes place in the liquid, and rapid expansion of the arc channel and liquid vaporization and expansion will result in outward radiation of a strong shock wave, which is one of the physical effects of the "electro-hydraulic effect." The mechanical effect of the "electro-hydraulic effect" is widely used in the areas of pipeline descaling, rock fracturing and crack creation, oil well plug removal and so on.

At present, conventional means of increasing production by oil and gas pipeline descaling mainly include chemical plug removal, fracturing plug removal, ultrasonic plug removal and the like. The methods of chemical plug removal and fracturing plug removal are gradually eliminated due to the complicated operation process and serious environmental pollution; the method of ultrasonic plug removal is difficult to generate strong ultrasonic waves in a high hydrostatic pressure environment of the oil and gas pipeline, and thus the plug removal effect is limited. In addition, the rock stratum fracturing technology generally has the problems of slow speed, long period, high cost and so on, and the rock fracturing cost in oil and gas stimulation is more than half of the exploration cost. The traditional rock breaking method by TNT explosives is poor in controllability of blasting and seriously pollutes the environment; the rock breaking method by ultrasonic mechanical energy and the like has the problems of low efficiency of rock breaking and so on.

At present, one of the bottlenecks that limit further application of the electro-hydraulic pulse shock waves is how to obtain high-strength pulse shock waves and how to control orientation and focused radiation of them accurately. Conventional methods for generating electro-hydraulic pulse shock waves are that the pulse power supply is applied to the underwater inter-electrode gap formed by the discharge electrodes. The electrodes are usually in the form of rod-plate electrodes, plate-plate electrodes and so on, and the high voltage electrode and the low voltage electrodes are directly exposed in the discharge liquid. Thus, the strongest point of the electric field is the tip of the anode and the cathode, and the length of the arc is approximately the minimum inter-electrode gap distance. Meanwhile, since the discharge electrodes for the generation of the pulse shock waves are placed directly in the liquid, the size of ends of the electrodes exposed in the liquid is large, leading to too large leakage energy in the liquid breakdown process and large breakdown distribute dispersion. When the plate-plate electrodes are used, the arc position is not fixed, and it is difficult to accurately regulate the shock wave; the plate-plate gap has a certain restraint on the shock wave propagation, while the breakdown electric field strength between the inter-electrode is relatively high, and the gap distance is relatively small, so that the length of the pulse arc is relatively short, the energy injection into the liquid gap is relatively low, and thus the energy conversion efficiency cannot be improved to generate a stronger shock wave. The use of needle-needle electrodes can reduce the breakdown field strength of the liquid gap to a certain extent, but the ablation performance of the needle electrodes is poor, which leads to the significant decrease of the life of the shock wave generator. In some cases of high hydrostatic pressure, the breakdown becomes more difficult, and simply use of the needle-needle electrodes may cause electric field distortion, thus limiting the effect of reducing the breakdown field.

SUMMARY OF THE INVENTION

In view of the defects of serious environmental pollution, low efficiency and poor controllability in the existing oil and gas pipeline descaling for increase in production and rock stratum fracturing technology, the present invention provides a pipeline descaling and rock stratum fracturing device based on electro-hydraulic pulse shock waves, which has the advantages of simple structure, good versatility and significant shock wave focusing and orienting radiation effect as well as being environmentally friendly, high-efficiency and easy to operation.

According to the invention, there is provided a pipeline descaling and rock stratum fracturing device based on electro-hydraulic pulse shock waves, comprising: a ground low-voltage control device, an electro-hydraulic pulse shock wave transmitter placed in the pipeline or rock hole and a logging cable for connecting the ground low-voltage control device to the electro-hydraulic pulse shock wave transmitter; the pulse shock wave transmitter includes: a high voltage converting unit, a high-temperature energy storage unit, a pulse compression unit, a liquid-electric pulse shock wave transmitting unit and a protection unit which are coaxially distributed in sequence along the axis; the high voltage converting unit is configured to convert an alternating current (AC) low voltage signal transmitted by the logging cable into a direct current (DC) high voltage signal; the high-temperature energy storage unit is configured to temporarily store the DC high voltage energy output by the high voltage converting unit as the total electric energy for the pulse discharge; the pulse compression unit is configured to control the energy stored in the high-temperature energy storage unit to be instantaneously applied to the pulse shock wave transmitting unit; the pulse shock wave transmitting unit is configured to generate a strong shock wave in a liquid with weak compressibility by a large pulse current under the action of a high voltage, and allow the generated shock wave to propagate outwards; the shock wave radiates in a preset focused direction through the focusing cavity, and is transferred into the oil and gas pipeline or the rock hole to touch the pipeline dirt or allow rock crack creation or fracturing; the protection unit is configured to ensure coaxality of the motion in the pipeline so as to avoid collision of the instrument with the pipeline wall. In addition, the ground low-voltage control device is configured to set the discharge voltage and the discharge times so as to achieve a good mechanical action effect; the logging cable is configured to transmit a power frequency low voltage to the pulse shock wave transmitter; the pulse shock wave transmitter is configured to generate a high-strength shock wave and allow the shock wave to orientatedly radiate outwards through a rotating parabolic cavity, and the shock wave acts on the pipeline to remove dirt or bombard the rock to form cracks. Based on efficient structure design of the electro-hydraulic pulse shock wave transmitter, the arc regulation technology and the shock wave focusing and oriented radiation control technology, the effect of pipeline descaling and rock stratum fracturing can be achieved.

Further, when the pipeline descaling and rock stratum fracturing device acts on a horizontal oil and gas pipeline or rock hole, the electro-hydraulic pulse shock wave transmitter further includes: a crawler configured to allow the electro-hydraulic pulse shock wave transmitter to crawl to a target position to be processed in the oil and gas pipeline or rock hole.

Further, the electro-hydraulic pulse shock wave transmitter can act on a vertical oil and gas pipeline or rock hole. In this case, the electro-hydraulic pulse shock wave transmitter goes deep into the pipeline or the rock hole to a fixed position under the action of its own gravity to complete the pulse discharge, and each discharge produces at least one shock wave, which effectively propagates in the radial direction to bombard the pipeline dirt or break the rock. In addition, the electro-hydraulic pulse shock wave transmitter can also act on a horizontal oil and gas pipeline or rock hole. In this case, the electro-hydraulic pulse shock wave transmitter crawls to a target position and each pulse discharge produces at least one shock wave, which effectively propagates in the radial direction to bombard the pipeline dirt or break the rock.

Further, the pulse compression unit includes a pulse compression switch and a control loop thereof; the pulse compression switch may be a gas switch, a vacuum trigger switch or other high-voltage solid switches; the control loop is used for outputting a trigger signal to allow the pulse compression switch to be rapidly turned on.

Further, the electro-hydraulic pulse shock wave transmitting unit includes: the discharge liquid, a high-voltage electrode and a low-voltage electrode; the high-voltage electrode and the low-voltage electrode are both immersed in the discharge liquid, and the high-voltage electrode and the low-voltage electrode are coaxially distributed along the same geometric central axis; the arc is formed by the high electric field strength between the high-voltage electrode and the low-voltage electrode and rapidly expands to form a pulse shock wave.

Further, the electro-hydraulic pulse shock wave transmitting unit further includes: an insulating fixing member sleeved on the high-voltage electrode or the low-voltage electrode and coaxially distributed. The electrodes are wrapped by the insulating fixing member with only the end portions of the electrodes exposed, or only one electrode is wrapped by the insulating fixing member with the end portion of the wrapped electrode exposed; the form of wrapping the electrode by the insulating fixing member in the discharge electrodes is suitable for any type of electrodes such as needle-needle electrodes, rod-rod electrodes, needle-plate electrodes. In addition, when only one electrode is wrapped by the insulating fixing member, the effect is independent of the polarity of the electrode, that is, the effect of improving the shock wave strength can be achieved whether the high-voltage electrode or the low-voltage electrode is wrapped.

Specifically, the high-voltage electrode is a needle electrode wrapped by the insulating fixing member with the exposed tip of the electrode and the low-voltage electrode is a plate electrode.

Further, the insulating fixing member and the plate electrode are respectively processed to form an upper focusing cavity and a lower focusing cavity according to the same parabolic curve equation.

In addition, the high-voltage electrode and the low-voltage electrode are coaxially distributed along the same geometric central axis, and the insulating fixing member or the plate low-voltage electrode is provided to form a rotating focusing cavity surface, so that by controlling geometrical parameters of the rotating focusing cavity, it is convenient to allow near-spherical shock waves generated between the high-voltage electrode and the low-voltage electrode to radiate in a preset focusing direction through the focusing cavity.

Preferably, the parabolic curve equation is $y^2=a(x+b)$, where y is the central axis of the high-voltage electrode, x is the horizontal symmetry axis of the upper focusing cavity and the lower focusing cavity, and a and b are constants.

Further, the material of the insulating fixing member is heat shrink tubing, epoxy, polyoxymethylene or polyether ketone. The insulating fixing member for wrapping the electrode may be any material with a certain mechanical strength and electrical insulation strength, such as heat shrink tubing, epoxy, polyoxymethylene or polyether ketone.

According to the parameters of the rotating parabolic cavity and the geometrical size of the electro-hydraulic pulse shock wave transmitting unit, the maximum action area of the shock wave transmitting unit can be determined, and according to the action range and action distance of the shock wave, the parameters can be optimized, so that the shock wave strength can be effectively increased and the mechanical effect of the shock wave can be improved.

Compared with the prior art, the invention has the following advantage effects:

(1) according to the pipeline descaling and rock stratum fracturing device based on electro-hydraulic pulse shock waves provided in the invention, since the arc regulation technology and the shock wave focusing and orienting radiation control technology are adopted, it not only can effectively remove the pipe dirt, fracturing the rock stratum and improve the permeability, but also has characteristics of simple operation, high reliability, environmental friendliness, low cost and so on.

(2) according to the discharge electrode adopting arc regulation technology provided in the invention, the inter-electrode electric field distribution is distorted, and thus the length of the development path of the discharge arc is obviously higher than the minimum inter-electrode gap distance, so that the length and impedance of the electro-hydraulic pulse arc is increased, the injected energy of the gap is improved, and thus effects of improving the shock wave energy conversion efficiency and improving the shock wave strength are achieved.

(3) according to the transmitting cavity adopting the shock wave focusing and orienting radiation control technology provided in the invention, a focusing cavity surface of the insulating fixing member is employed, which can lengthen the smallest distance along the surface between the high-voltage electrode and the low-voltage electrode to increase the breakdown voltage therebetween, so that the electrical insulation strength of the transmitting cavity is enhanced. Also, the geometric center of the initial arc is located exactly at the focal point of the focusing cavity formed by the plate electrode and the insulating fixing member, which greatly improving the shock wave strength.

DETAILED DESCRIPTION OF THE PREFERRED EMBODIMENTS

Figure 1:
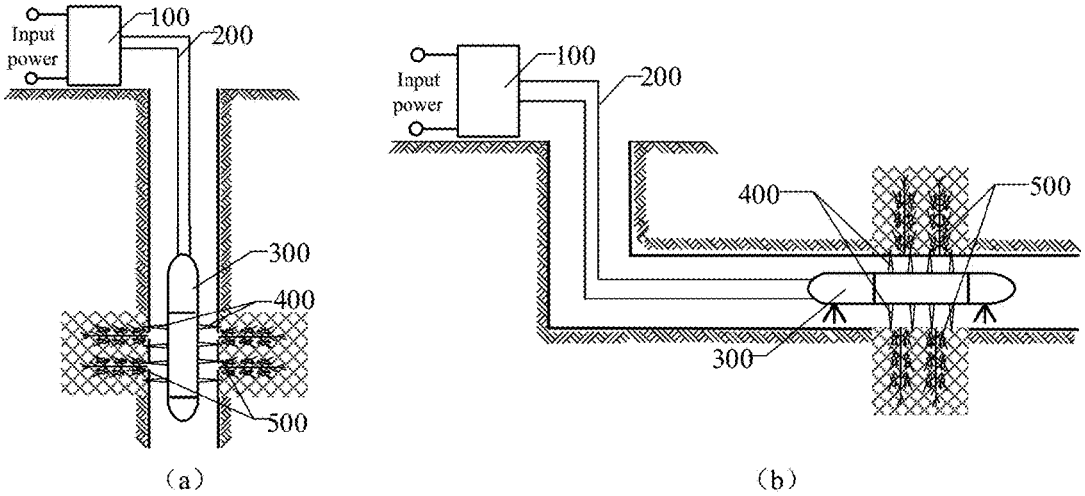
FIG. 1 is a schematic structural diagram of a pipeline descaling and rock stratum fracturing device based on electro-hydraulic pulse shock waves according to the invention, in which (a) shows a case where the pulse shock wave transmitter acts on a vertical oil and gas pipeline or rock hole; and (b) shows a case where the pulse shock wave transmitter acts on a horizontal oil and gas pipeline or rock hole.

For clear understanding of the objectives, features and advantages of the invention, detailed description of the invention will be given below in conjunction with accompanying drawings and specific embodiments. It should be noted that the embodiments described herein are only meant to explain the invention, and not to limit the scope of the invention.

The invention provides a pipeline descaling and rock stratum fracturing device based on electro-hydraulic pulse shock waves, comprising: a ground low-voltage control device 100, a transmission cable 200 and an electro-hydraulic pulse shock wave transmitter 300. The ground low-voltage control device 100, the transmission cable 200 and the electro-hydraulic pulse shock wave transmitter 300 are ensured to have good electrical insulation and mechanical strength through oil well joints. According to actual working conditions of the pipeline or rock, by controlling the ground low-voltage control device 100, the electro-hydraulic pulse shock wave transmitter 300 can be allowed to generate shock waves 400 so as to control the strength, the number of times and the repetition frequency of the shock waves, so that the optimal effect of pipeline descaling or rock stratum fracturing 500 is achieved.

The core of the invention lies in the structure design, the arc regulation technology and the radiation direction control of the shock wave induced by the pulse shock wave transmitter 300 so as to achieve objectives of bombardment or breaking of the pipeline or the rock at a specific position. The specific working process of the invention is: according actual working conditions, the job specification of plug removal for production increase is made; the optimal type of the discharge electrodes of the electro-hydraulic pulse shock wave transmitter 300 is determined and each electro-hydraulic pulse discharge generates one effective high-strength shock wave, which then expands outwards in a near-spherical manner; through refraction and reflection of the rotating parabolic cavity, the radial shock wave is focused in a horizontal direction and radiates outwards to act on the oil and gas pipeline or the rock hole such that the blockage attached around the pipe is broken and then enters the oil well under the hydrostatic pressure, so that pipeline descaling is achieved; the shock wave acts on the surface of the rock stratum such that gradually deepened and penetrating plane cracks, which extend in a radial direction, occur in the rock, and multiple strong shock waves enable the rock to be fractured.

The electro-hydraulic pulse shock wave transmitter 300 is used for generating a high-strength shock wave and allowing the shock wave to radiate in a preset direction through the rotating parabolic cavity so as to act on the pipeline to remove dirt for oil and gas production increase or bombard the rock to achieve rock crack creation or fracturing.

The electro-hydraulic pulse shock wave transmitter 300 can act on a vertical oil and gas pipeline or rock hole. In this case, the electro-hydraulic pulse shock wave transmitter 300 goes deep into the pipeline or the rock hole to a fixed position under the action of its own gravity to complete the pulse discharge, and at least one effective horizontal focused shock wave is generated to bombard the pipeline or break the rock.

The electro-hydraulic pulse shock wave transmitter 300 can act on a horizontal oil and gas pipeline or rock hole. In this case, the electro-hydraulic pulse shock wave transmitter 300 may go to a target position of the pipeline or the rock hole by virtue of a crawler, and at least one effective vertical focused shock wave is generated to bombard the pipeline or break the rock.

The electro-hydraulic pulse shock wave transmitter 300 according to the invention comprises: a high voltage converting unit 301, a high-temperature energy storage unit 302, a pulse compression unit 303, an electro-hydraulic pulse shock wave transmitting unit 304 and a protection unit 305. The respective units of the electro-hydraulic pulse shock wave transmitter are coaxially distributed along the axis, which is beneficial to increase of the overall mechanical strength. In the electro-hydraulic pulse shock wave transmitter, the protection unit 305 is configured to ensure coaxality of the motion in the pipeline so as to avoid collision of the instrument with the pipeline wall; the high voltage converting unit 301 is configured to efficiently convert an AC low voltage transmitted by the logging cable into a DC high voltage through a full bridge or half bridge rectification manner; the high-temperature energy storage unit 302 adopts a multi-cascaded pulse capacitor unit which has short-circuit current impact resistance, excellent high temperature performance and long service life, and is configured to temporarily store the DC voltage energy output by the high voltage converting unit 301 as the total electric energy for the electro-hydraulic pulse discharge for a long time; and the pulse compression unit 303 is configured to control the energy stored in the high-temperature energy storage unit to be instantaneously applied to the electro-hydraulic pulse shock wave transmitting unit.

The pulse compression unit 303 includes a pulse compression switch and a control loop thereof, and the ground low-voltage control device 100 applies a trigger control signal transmitted by the special transmission cable to a preset trigger terminal of the pulse compression switch, in which the pulse compression switch may be a gas switch, a vacuum trigger switch or other high-voltage solid switches, and the control loop is used for outputting a trigger signal to allow the pulse compression switch to be rapidly turned on.

The working process of the electro-hydraulic pulse shock wave transmitting unit 304 is: the electro-hydraulic pulse shock wave discharge gap is broken down under the action of a high voltage, and through the resulting large pulse current, a strong shock wave is generated in the discharge liquid with weak compressibility and propagates outwards; the shock wave radiates in a preset focused direction through the focusing cavity, and is finally transferred to the oil and gas pipeline or the rock hole to touch the pipeline dirt or enable the rock crack creation or fracturing.

The electro-hydraulic pulse shock wave transmitting unit 304 includes a discharge liquid 3040, a high-voltage electrode 3041, a low-voltage electrode 3042 and the insulating fixing member 3044; the high-voltage electrode 3041 and the low-voltage electrode 3042 are coaxially distributed along the axis, and the insulating fixing member 3044 and the high-voltage and low-voltage electrodes 3041, 3042 are coaxially distributed; and the high-voltage and low-voltage electrodes 3041, 3042 are both immersed in the discharge liquid to constitute the electro-hydraulic pulse shock wave transmitting unit 304.

The pipeline descaling and rock stratum fracturing device based on electro-hydraulic pulse shock waves according to the invention adopts the arc regulation technology, in which the high-voltage electrode 3041 and the low-voltage electrode 3042 are both wrapped by the insulating fixing member 3044 with only the ends of the electrodes exposed, or one of the high-voltage electrode 3041 and the low-voltage electrode 3042 is wrapped by the insulating fixing member 3044 with only the end of the wrapped electrode exposed; in this case, the inter-electrode electric field distribution of the space charge attached to the insulation surface is distorted, the arc would develop along the distortion point of the electric field and thus due to the action of the coulomb force, the length of the arc is significantly larger than the minimum inter-electrode gap distance, which is beneficial to increase of the shock wave strength.

In addition, the form of wrapping the electrode by the insulating fixing member 3044 in the arc regulation technology is suitable for any type of electrodes such as needle-needle electrodes, rod-rod electrodes, needle-plate electrodes and plate-plate electrodes.

In addition, when only one electrode is wrapped by the insulating fixing member 3044 in a case of adopting the arc regulation technology, the effect is independent of the polarity of the electrode. To a certain extent, the effect of improving the shock wave strength can be achieved whether the high-voltage electrode 3041 or the low-voltage electrode 3042 is wrapped.

In addition, in a case of adopting the arc regulation technology, the insulating fixing member 3044 for wrapping the electrode may be any material with a certain mechanical strength and electrical insulation strength, such as heat shrink tubing, epoxy, polyoxymethylene or polyether ketone.

In the pipeline descaling and rock stratum fracturing device based on electro-hydraulic pulse shock waves according to the invention, the transmitting cavity adopts the shock wave focusing and orienting radiation control technology, in which the rod high-voltage electrode 3041 and the plate low-voltage electrode 3042 are coaxially distributed along the same geometric central axis, the high-voltage electrode 3041 is wrapped by the insulating fixing member 3044 and the low-voltage electrode 3042 is directly exposed in the discharge liquid 3040. The insulating fixing member 3044 and the plate low-voltage electrode 3042 are respectively processed to form an upper focusing cavity and a lower focusing cavity according to the same parabolic curve equation, and according to the linear reflection law, the spherical shock wave at the focus point parallelly radiates in the cavity opening direction though the reflecting action of the focusing cavity, so that focusing and orienting radiation control of the shock wave is achieved.

In addition, the cavity surface of the parabolic focusing cavity formed by the insulating fixing member 3044 and the low-voltage electrode 3042 is formed by rotating the parabolic curve equation is $y^2=a(x+b)$, where y is the central axis of the high-voltage electrode, x is the horizontal symmetry axis of the upper focusing cavity and the lower focusing cavity, and a and b are constants.

In addition, the geometric center of the focusing cavity is located exactly on the axis of the shock wave transmitter 300 whose diameter is a certain value, and thus by setting the opening coefficients a and b of the parabola, the maximum opening diameter d of the rotating parabolic focusing cavity and the maximum action area s can be determined. In a case where the energy of the electro-hydraulic pulse shock wave and the action distance are both constant, the maximum action area s of the shock wave transmitting unit determines the energy density at the shock wave action point. Therefore, according to actual working conditions of the shock wave transmitter 300 and the required energy density, the action range and the action distance of the shock wave can be determined, and thus the proper opening diameter d of the focusing cavity can be set so as to achieve the optimal shock wave focusing and orienting effect.

In addition, since the breakdown distance along the surface is increased due to the focusing cavity surface of the insulating fixing member 3044, the electric insulation strength can be improved; the geometric center of the initial arc is located exactly at the focal point of the focusing cavity formed by the plate electrode and the insulating fixing member to improve the shock wave strength, thereby achieving the optimal focusing effect.

FIG. 1 shows structures of the pipeline descaling and rock stratum fracturing devices based on electro-hydraulic pulse shock waves, in which (a) of FIG. 1 shows a case where the pulse shock wave transmitter acts on a vertical oil and gas pipeline or rock hole; and (b) of FIG. 1 shows a case where the pulse shock wave transmitter acts on a horizontal oil and gas pipeline or rock hole. For ease of description, detailed description are provided below with reference to the accompanying figures and specific examples.

The structures of two pipeline descaling and rock stratum fracturing devices based on electro-hydraulic pulse shock waves in (a) and (b) of FIG. 1 both have a ground low-voltage power supply control device 100, a logging cable 200 and a electro-hydraulic pulse shock wave transmitter 300. The ground low-voltage power supply control device can adopt an AC generator of 220V/50 Hz as the power supply, and the generator has a power of not less than 10 kW and is east to transport and operate. The ground low-voltage power supply control device converts a power frequency voltage of 220V into an adjustable intermediate frequency voltage of 0-1.8 kV with a frequency of 1 kHz. The logging cable has a rated voltage of 6 kV and a resistance of 30 Ω/km. The other end of the logging cable is connected to the electro-hydraulic pulse shock wave transmitter through a universal interface of the oil well.

The two differ in that the shock wave transmitter in (a) of FIG. 1 acts on a vertical oil and gas pipeline or rock hole and can be located in a working position by virtue of its own gravity, while the shock wave transmitter in (b) of FIG. 1 acts on a horizontal oil and gas pipeline or rock hole and in this case, crawls to a target position by virtue of a crawler 306 which is connected between the logging cable 200 and the electro-hydraulic pulse shock wave transmitter 300. If the electro-hydraulic pulse shock wave transmitter 300 needs to be placed in the horizontal oil and gas pipeline or rock hole, an instruction is issued to open four draft arms of the crawler 306 such that four road wheels of the crawler 306 are tightly pressed against the inner wall of the oil well casing or the rock hole. The four road wheels of the crawler 306 are driven by a mechanical drive device to walk along the casing so that the logger is conveyed to a designated location. When the logger reaches the predetermined position, the crawler stops walking and retracts the draft arms. At this time, the electro-hydraulic pulse shock wave transmitter 300 starts the electro-hydraulic pulse discharge operation. Each pulse discharge produces at least one shock wave which effectively radiates in a preset direction to bombard the pipeline or fracture the rock stratum, so as to achieve the pipeline descaling or the rock crack creation or fracturing.

Figure 2:
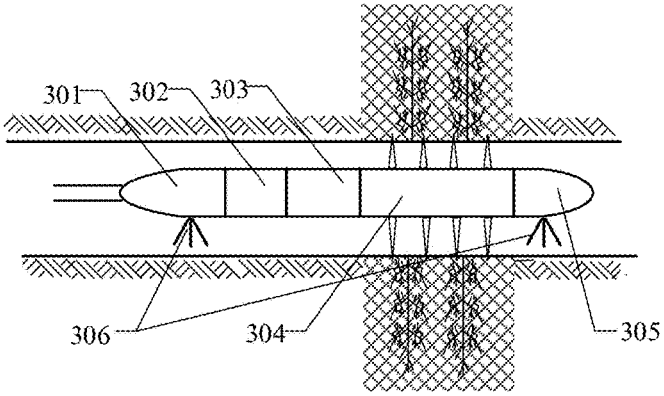
FIG. 2 is a schematic structural diagram of an electro-hydraulic pulse shock wave transmitter in the pipeline descaling and rock stratum fracturing device based on electro-hydraulic pulse shock waves according to the invention.

The pipeline descaling and rock stratum fracturing device according to the invention is the core of the invention, and its structure is shown in FIG. 2. Specifically, the electro-hydraulic pulse shock wave transmitter 300 includes: a high voltage converting unit 301, a high-temperature energy storage unit 302, pulse compression unit 303, an electro-hydraulic pulse shock wave transmitting unit 304 and a protection unit 305, in which the protection unit 305 is configured to ensure coaxality of the motion in the pipeline so as to avoid collision of the instrument with the pipeline wall; the high voltage converting unit 301 is configured to convert a low voltage with power frequency into a high voltage with medium-high frequency and then output a DC high voltage after rectification; the high-temperature energy storage unit 302 is configured to temporarily store the DC voltage energy output by the high voltage converting unit 301 as the total electric energy for the electro-hydraulic pulse discharge for a long time; the pulse compression unit 303 is configured to control the energy stored in the high-temperature energy storage unit 302 to be instantaneously applied to the electro-hydraulic pulse shock wave transmitting unit 304; and a high-strength shock wave, which is radiated by the arc passage induced by the inter-electrode high electric field of the electro-hydraulic pulse shock wave transmitting unit 304, propagates in a focus-controllable direction. In addition, the basic parameters of the electro-hydraulic pulse shock wave transmitter 300 are: an outer diameter of 102 mm and a total length of 5.7 m. The DC voltage output by the high voltage converting unit is 30 kV. The high-temperature energy storage unit has a single-stage capacitance of 1.5 μF and a rated voltage of 30 kV. In the present embodiment, the high-temperature energy storage unit adopts two-stage cascade connection, and has a capacitance of 3.0 μF, a rated stored energy of 1.35 kJ, a rated working temperature of 120° C., and a service life of more than 10,000 times. The pulse compression unit adopts a vacuum trigger switch with a rated voltage of 30 kV, a maximum current peak value of 50 kA and a charge transferring amount of greater than 100 kC.

Figure 3:
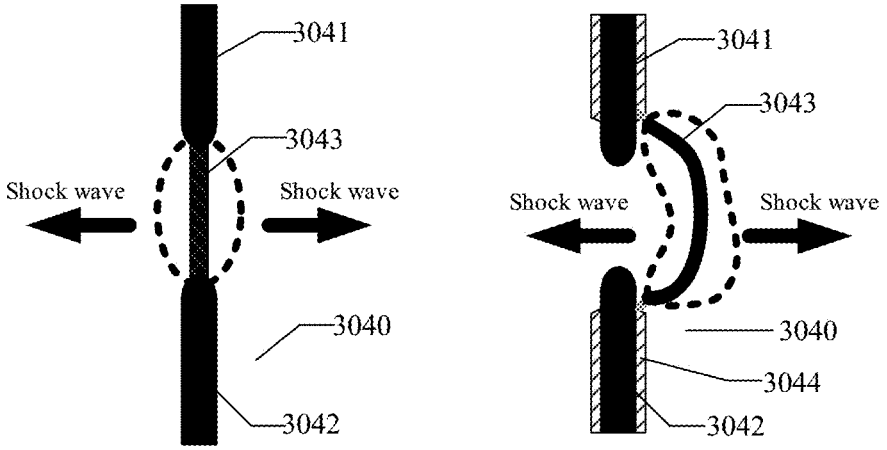
FIG. 3 is a schematic diagram showing a case where the discharge electrodes adopt the arc regulation technology in the pipeline descaling and rock stratum fracturing device based on electro-hydraulic pulse shock waves according to the invention, in which (a) is a schematic diagram of the arc development without the arc regulation technology, and (b) is a schematic diagram of the arc development with the arc regulation technology.

Schematic diagrams of arc development of the electro-hydraulic pulse shock wave transmitting unit 304 without and with the arc regulation technology are respectively shown in (a) and (b) of FIG. 3. The electro-hydraulic pulse shock wave transmitting unit 304 includes the discharge liquid 3040, a high-voltage electrode 3041, a low-voltage electrode 3042 and so on, whether the arc regulation technology is employed or not. In a case of adopting the arc regulation technology, the high-voltage electrode 3041 and the low-voltage electrode 3042 are wrapped by the insulating fixing member 3044 on the outside. The length of the arc 3043 shown in (a) of FIG. 3 is approximately equal to the shortest inter-electrode distance, while the length of the development path of the discharge arc 3043 in (b) of FIG. 3 in a case of adopting the arc regulation technology is significantly larger than the minimum inter-electrode gap distance due to the fact that the inter-electrode electric field distribution of the space charge attached to the insulation surface is distorted and the arc would develop along the distortion point of the electric field. Therefore, in a case of adopting the arc regulation technology, the length of the arc can be increased to increase the length and impedance of the electro-hydraulic pulse arc and improve the injected energy of the gap so as to achieve effects of improving the shock wave energy conversion efficiency and improving the shock wave strength.

Figure 4:
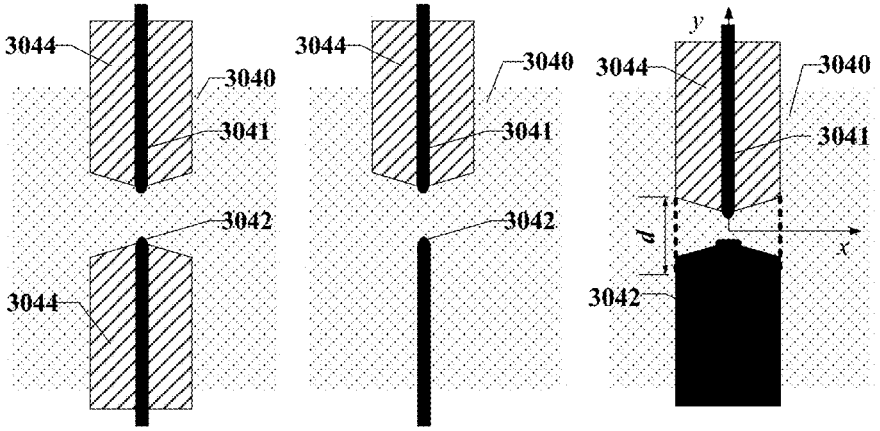
FIG. 4 is a schematic diagram of modified discharge electrodes in the pipeline descaling and rock stratum fracturing device based on electro-hydraulic pulse shock waves according to the invention, in which (a) is a schematic structural diagram showing a case where a high-voltage electrode and a low-voltage electrode are both wrapped by the insulating fixing member; (b) is a schematic structural diagram showing a case where the high-voltage electrode is wrapped by the insulating fixing member and the low-voltage electrode is a rod electrode; and (c) is a schematic structural diagram showing a case where the high-voltage electrode is wrapped by the insulating fixing member and the low-voltage electrode is a plate electrode.

In the electro-hydraulic pulse shock wave transmitting unit 304, as shown in (a) of FIG. 4, the high-voltage electrode 3041 and the low-voltage electrode 3042 can be wrapped by the insulating fixing member, or as shown in (b) and (c) of FIG. 4, only the high-voltage electrode is wrapped and the tip of the low-voltage electrode may be set to be a rod or plate electrode. The high-voltage electrode 3041 and the low-voltage electrode 3042 are coaxially distributed along the axis, and the insulating fixing member 3044 and the high-voltage and low-voltage electrodes 3041, 3042 are coaxially distributed. The high-voltage electrode 3041 and the low-voltage electrode 3042 are both immersed in the discharge liquid 3040. In addition, the plate low-voltage electrode 3042 and the insulating fixing member 3044 may be designed as a rotated parabolic focusing cavity, as shown in (c) of FIG. 4. The insulating fixing member 3044 and the plate low-voltage electrode 3042 are respectively processed to form an upper focusing cavity and a lower focusing cavity according to the same parabolic curve equation. According to the linear reflection law, the spherical shock wave at the focus point parallelly radiates in the cavity opening direction though the reflecting action of the focusing cavity, so that focusing and orienting radiation control of the shock wave is achieved. According to actual working conditions of the shock wave transmitter 300 and the required energy density, the action range and the action distance of the shock wave can be determined, and thus the proper opening diameter d of the focusing cavity can be set so as to achieve the optimal shock wave focusing and orienting effect.

Figure 5:
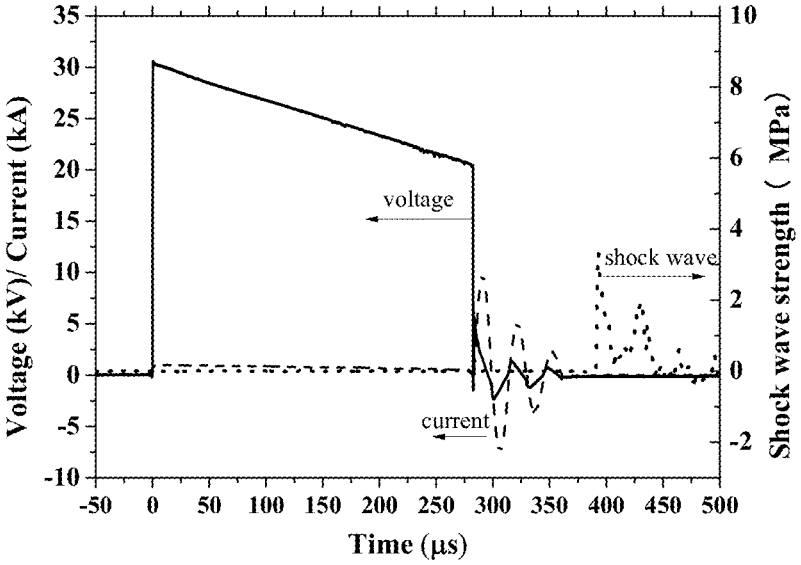
FIG. 5 is a schematic diagram illustrating typical waveforms of voltages, currents and shock waves without and with electrode modification in the pipeline descaling and rock stratum fracturing device based on electro-hydraulic pulse shock waves according to the invention, in which (a) is a schematic diagram of the typical waveforms of the discharge voltage, the current and the shock wave without the arc regulation technology; (b) is a schematic diagram of a typical waveforms of the discharge voltage, the current and the shock wave with the arc regulation technology.
Figure 5:
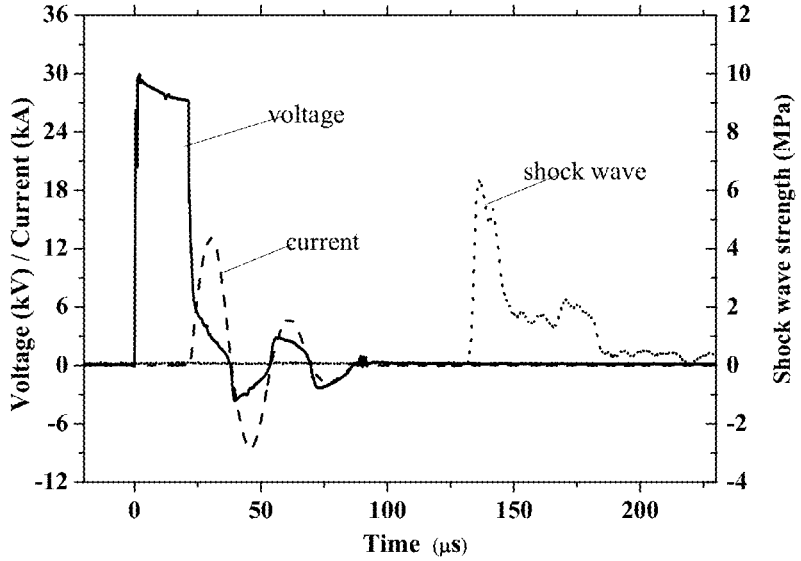

In this embodiment, the typical discharge voltages, currents and shock wave waveforms without and with the arc regulation technology are shown in (a) and (b) of FIG. 5, respectively. It can be seen that when the conventional discharge electrode is employed, the breakdown delay is obviously higher than that in a case of adopting the arc regulation technology, the energy consumed by the pre-breakdown process is larger, the energy conversion efficiency is lower and thus the shock wave strength is lower. In a case of adopting the arc regulation technology, the horizontal distance between the shock wave measurement probe and the middle of the shock wave transmitter is 17 cm, the measured strength of the shock wave is about 6 MPa and the pulse width is about 50 μs. When the discharge electrode with the arc regulation technology is employed, the maximum liquid gap that can be broken down is about twice that in a case of employing the conventional electrode, which corresponds to that the breakdown field strength is reduced to half of the original.

Figure 6:
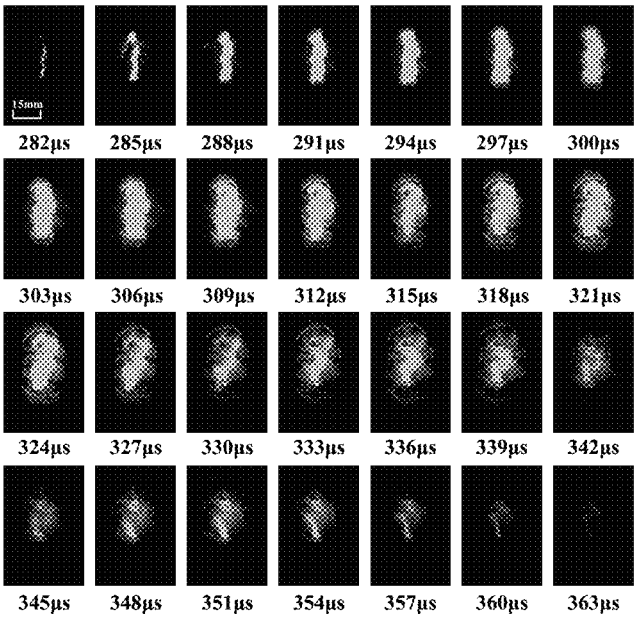
FIG. 6 is a schematic diagram illustrating the arc development images without and with electrode modification in the pipeline descaling and rock stratum fracturing device based on electro-hydraulic pulse shock waves according to the invention, in which (a) is a schematic diagram of the arc development images without the arc regulation technology; and (b) is a schematic diagram of the arc development images with the arc regulation technology.
Figure 6:
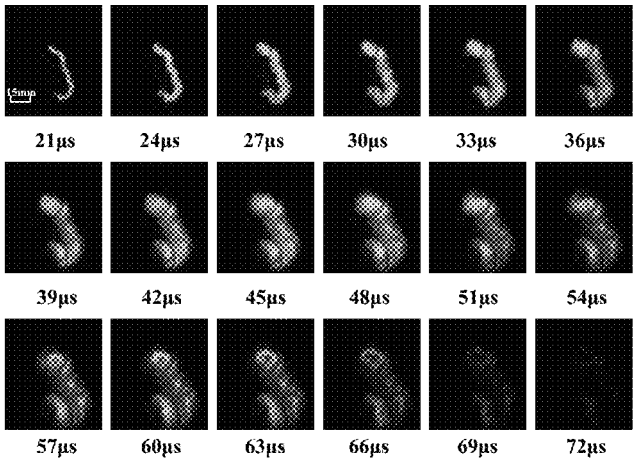

(a) and (b) of FIG. 6 show schematic diagrams of the arc development trend without and with the arc regulation technology in this embodiment, respectively. It can be seen that after adopting the arc regulation technology, the inter-pole arc length is increased from 17 mm to 28 mm, and the arc is changed into a curved type from a linear type. At this time, the injected energy of the arc channel transformed from the total electric energy in gap breakdown is increased from about 3% to 10%, and the shock wave strength is improved by about 1 time.

Figure 7:
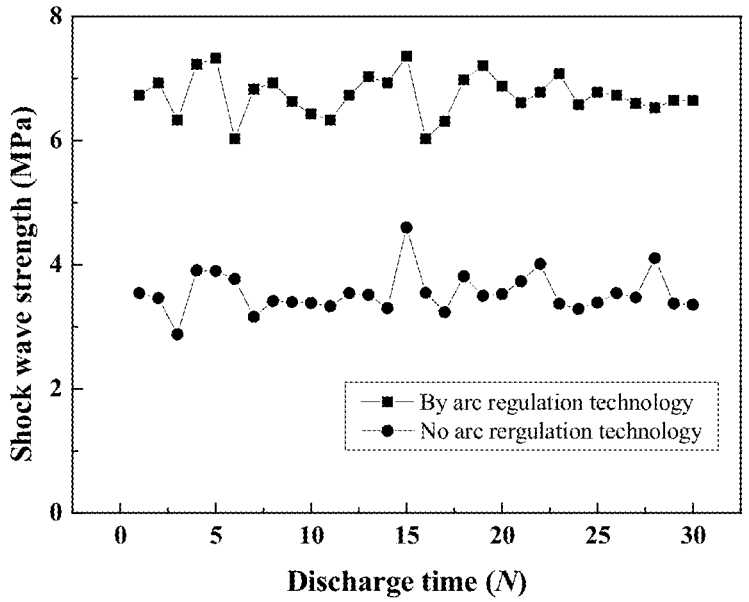
FIG. 7 is a scatter diagram of test results of the shock wave strength without and with the arc regulation technology in the pipeline descaling and rock stratum fracturing device based on electro-hydraulic pulse shock waves according to the invention.

FIG. 7 is a scatter diagram of test results of the shock wave strength without and with the arc technology in the invention. The average value of the shock wave strength without the arc regulation technology is about 3.55 MPa, while the average value of the shock wave strength with the arc regulation technology is about 6.74 MPa. It can be seen from the test results that the average value of the shock wave strength is increased from 3.55 MPa to 6.74 MPa after the arc regulation technology is employed, that is, the shock wave strength enhancement effect is remarkable.

Figure 8:
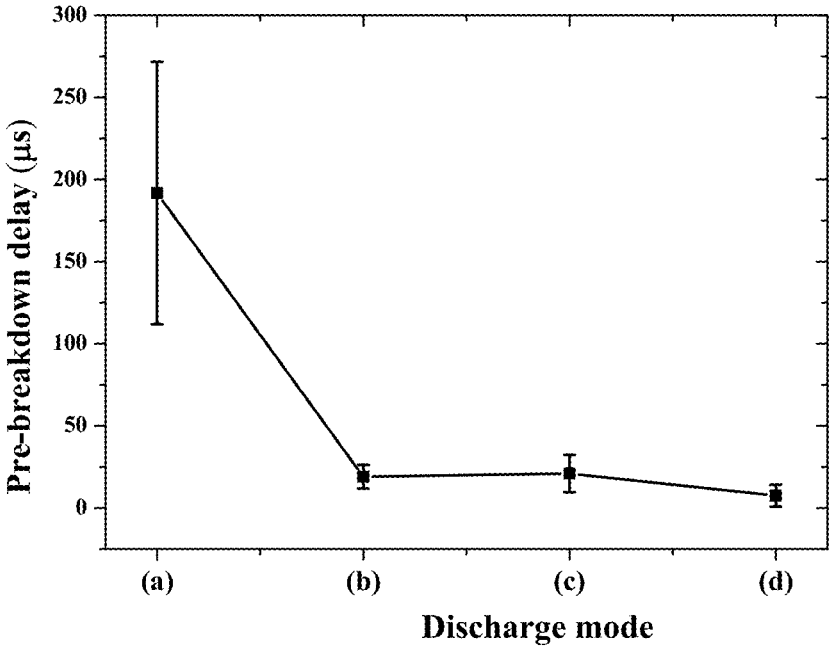
FIG. 8 is a schematic diagram illustrating a distribution rule of breakdown delays without and with electrode modification in the pipeline descaling and rock stratum fracturing device based on electro-hydraulic pulse shock waves according to the invention.

FIG. 8 is a schematic diagram showing a distribution rule of pre-breakdown delays in a case of different types of electrodes in this embodiment. The results show that when the conventional discharge electrode is employed, not only the average pre-breakdown delay reaches hundreds of microseconds, but also the dispersion is very large; in a case of adopting the arc regulation technology, whether the needle-needle electrodes are employed or the needle-plate electrodes are employed and whether the high-voltage and low-voltage discharge electrodes are wrapped with only ends of the electrodes exposed, or only the high-voltage discharge electrode is wrapped with only the end of the wrapped electrode exposed, the average breakdown delay is only about ten microseconds, and has good consistency.

Figure 9:
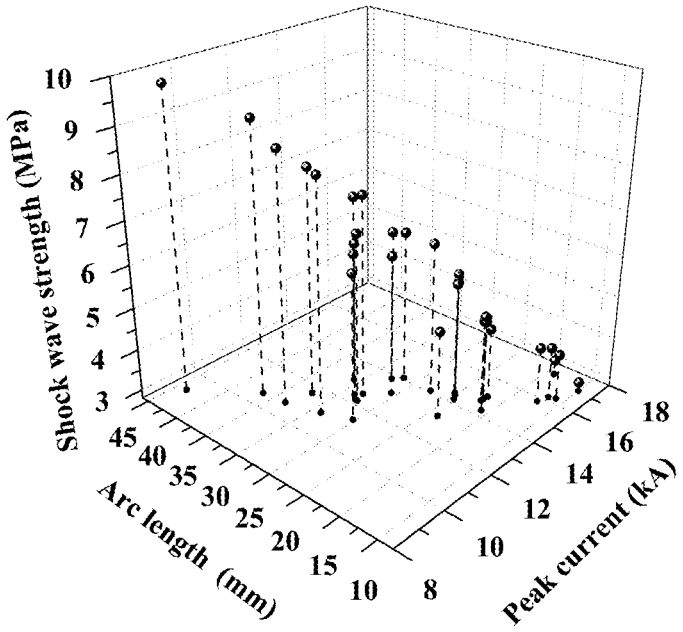
FIG. 9 is a schematic diagram illustrating a corresponding relationship between the shock wave strength and the arc length and peak current value in the pipeline descaling and rock stratum fracturing device based on electro-hydraulic pulse shock waves according to the invention.

FIG. 9 is a schematic diagram illustrating a corresponding relationship between the shock wave strength and the arc length and current peak value with the arc regulation technology in this embodiment. As the arc length increases, the current peak value gradually decreases, and the shock wave strength trends to increase. The strength of the electro-hydraulic pulse shock wave increases with the increase of the energy injected into the gap, and the energy injected into the gap is closely related to the impedance of the electro-hydraulic pulse arc, so that the larger the impedance of the arc is, the larger the injected energy is.

In order to verify the effect of pipeline descaling and rock stratum fracturing produced by this electro-hydraulic pulse shock wave, preliminary test simulation is performed on this device in an atmospheric environment with room temperature and normal pressure. In the test, the electro-hydraulic pulse shock wave transmitter is located in the center of the oil well pipeline or the rock hole. The cement cylinder is used to simulate the oil well pipeline structure, a stainless steel inner cylinder is provided inside the cement cylinder and holes with a diameter of 20 mm are opened on the surface to simulate perforation. The inner and outer cement layer thickness is 12 mm, and after the action of one electro-hydraulic pulse shock wave, the blockage holes in the action range of the electro-hydraulic pulse shock wave are dredged by 100%. A rock sample with an outer diameter of 670 mm, an inner diameter of 130 mm and a height of 500 mm is used to simulate the fracturing effect of the device on the rock. With the increase of number of times of discharge, longitudinally penetrating cracks from the inside to the outside occurs in the rock sample, and after about 20 times of discharge, the rock sample is fractured along the longitudinally penetrating cracks so that the effect of rock crack creation and fracturing.

While particular embodiments of the invention have been shown and described, it will be obvious to those skilled in the art that changes and modifications may be made without departing from the spirit and scope of the invention.

The invention claimed is:

1. A pipeline descaling and rock stratum fracturing device based on electro-hydraulic pulse shock waves, the pipeline descaling and rock stratum fracturing device comprising:

a ground low-voltage control device, an electro-hydraulic pulse shock wave transmitter configured to be placed in a pipeline or rock hole, the electro-hydraulic pulse shock wave transmitter including a high voltage converting unit, a high-temperature energy storage unit, a pulse compression unit, an electro-hydraulic pulse shock wave transmitting unit, and a protection unit which are coaxially distributed in sequence along an axis of the electro-hydraulic pulse shock wave transmitter; and a logging cable for connecting the ground low-voltage control device to the electro-hydraulic pulse shock wave transmitter, wherein the high voltage converting unit is configured to convert an AC low voltage signal transmitted by the logging cable into a direct current high voltage signal, the high-temperature energy storage unit configured to store electrical energy of the direct current high voltage signal, and the pulse compression unit configured to apply the electrical energy stored in the high-temperature energy storage unit as an electrical current pulse to the electro-hydraulic pulse shock wave transmitting unit to generate a shock wave, the electro-hydraulic pulse shock wave transmitting unit including a high-voltage electrode and a low-voltage electrode, the high-voltage electrode being one of a needle electrode or a rod electrode, the low-voltage electrode being one of a needle electrode or a rod electrode, the high-voltage electrode and the low-voltage electrode each having an end portion immersed in a discharge liquid with a discharge gap formed between the high-voltage electrode and the low-voltage electrode in the discharge liquid, the electro-hydraulic pulse shock wave transmitting unit configured to generate the shock wave in the discharge liquid by the electrical current pulse causing an electrical breakdown of the discharge gap under the action of a high voltage that forms an electric arc, and to propagate the generated shock wave outwards and external to the pipeline descaling and rock stratum fracturing device.

2. The pipeline descaling and rock stratum fracturing device of claim 1, wherein the electro-hydraulic pulse shock wave transmitter further includes a crawler configured to allow the electro-hydraulic pulse shock wave transmitter to crawl to a target position to be processed in the pipeline or rock hole when the pipeline or rock hole is horizontal.

3. The pipeline descaling and rock stratum fracturing device of claim 1, wherein the pulse compression unit includes a pulse compression switch and a control loop thereof, the pulse compression switch being a high-voltage solid switch, and the control loop configured to output a trigger signal that turns on the pulse compression switch.

4. The pipeline descaling and rock stratum fracturing device of claim 1, wherein the electro-hydraulic pulse shock wave transmitting unit includes the discharge liquid, the high-voltage electrode and the low-voltage electrode being coaxially distributed along a same geometric central axis, and the electrical breakdown of the discharge gap caused by a high field strength between the high-voltage electrode and the low-voltage electrode.

5. The pipeline descaling and rock stratum fracturing device of claim 4, wherein the electro-hydraulic pulse shock wave transmitting unit further includes a first insulating fixing member, the low-voltage electrode being wrapped by the first insulating fixing member with the end portion of the low-voltage electrode being exposed.

6. The pipeline descaling and rock stratum fracturing device of claim 5, wherein the electro-hydraulic pulse shock wave transmitting unit further includes a second insulating fixing member, the high-voltage electrode being wrapped by the second insulating fixing member with the end portion of the high-voltage electrode being exposed.

7. The pipeline descaling and rock stratum fracturing device of claim 6, wherein the high-voltage electrode is a needle electrode wrapped by the second insulating fixing member, and the low-voltage electrode is a needle electrode wrapped by the first insulating fixing member.

8. The pipeline descaling and rock stratum fracturing device of claim 6, wherein the first insulating fixing member and the second insulating fixing member form an upper focusing cavity and a lower focusing cavity according to a same parabolic curve equation.

9. The pipeline descaling and rock stratum fracturing device of claim 8, wherein the parabolic curve equation is $y^2=(x+b)$, in which y is a central axis of the high-voltage electrode, x is a horizontal symmetry axis of the upper focusing cavity and the lower focusing cavity, and a and b are constants.

10. The pipeline descaling and rock stratum fracturing device of claim 5, wherein the insulating fixing member is made of a high-strength insulating material with high temperature resistance and corrosion resistance.

11. The pipeline descaling and rock stratum fracturing device of claim 10, wherein the high-strength insulating material is one of heat shrink tubing material, an epoxy, polyoxymethylene, and polyether ketone.

12. The pipeline descaling and rock stratum fracturing device of claim 1, wherein the protection unit is configured to ensure coaxiality of motion of the electro-hydraulic pulse shock wave transmitter in the pipeline or rock hole to avoid collision with a wall of the pipeline or rock hole.

13. The pipeline descaling and rock stratum fracturing device of claim 1, wherein the electro-hydraulic pulse shock wave transmitting unit includes a focusing cavity, the generated shock wave radiates in a preset focused direction through the focusing cavity.

* * * * *